US006903698B2

(12) United States Patent
Silva

(10) Patent No.: US 6,903,698 B2
(45) Date of Patent: Jun. 7, 2005

(54) CONTACT SPRING ASSEMBLY FOR ANTENNA UNITS OF MOTOR VEHICLES

(75) Inventor: David Silva, Neckartenzlingen (DE)

(73) Assignee: Hirschmann Electronics GmbH & Co. KG, Neckartenzlingen (DE)

( * ) Notice: Subject to any disclaimer, the term of this patent is extended or adjusted under 35 U.S.C. 154(b) by 0 days.

(21) Appl. No.: 10/732,921

(22) Filed: Dec. 10, 2003

(65) Prior Publication Data

US 2004/0174310 A1 Sep. 9, 2004

(30) Foreign Application Priority Data

Dec. 11, 2002 (DE) ..... 102 58 101

(51) Int. Cl.[7] ..... H01Q 1/32
(52) U.S. Cl. ..... 343/713; 343/906
(58) Field of Search ..... 315/711, 712, 315/713, 906

(56) References Cited

U.S. PATENT DOCUMENTS 6,025,806 A * 2/2000 Deininger et al. ..... 343/906
6,087,996 A * 7/2000 Dery ..... 343/713
6,411,259 B1 * 6/2002 Wendt et al. ..... 343/713

FOREIGN PATENT DOCUMENTS

EP 1 080 513 3/2001

* cited by examiner

*Primary Examiner*—Don Wong
*Assistant Examiner*—Ephrem Alemu
(74) *Attorney, Agent, or Firm*—Herbert Dubno

(57) ABSTRACT

An antenna assembly for a motor vehicle and especially for an antenna structure on a window of such vehicle in which a support plate is provided between an antenna amplifier and the antenna structure and has at least one but preferably a plurality of spring contacts locked through openings in the support plate and having arcuate portions respectively engageable with contact points on the antenna amplifier and contact pads of the antenna structure.

15 Claims, 9 Drawing Sheets

CONTACT SPRING ASSEMBLY FOR ANTENNA UNITS OF MOTOR VEHICLES

FIELD OF THE INVENTION

My present invention relates to a contact assembly for an antenna unit of a motor vehicle and, more particularly, to an assembly in which a contact spring makes electrical contact between an electrical or electronic component, such as an antenna amplifier, and a contact pad or location of an antenna structure which may be mounted on the vehicle and can be, for example, printed circuit antenna elements on a vehicle window or embedded conductors in that window terminating at contact pads along an edge thereof.

BACKGROUND OF THE INVENTION

EP 1 080 513 B1 describes a vehicle antenna having at least one antenna structure on a window of that vehicle, the antenna structure, in turn, having contact pads or foot points adapted to make electrical contact with an electronic or electrical device, especially an antenna amplifier.

The contact points can be juxtaposed with a base composed of nonconductive material carrying the antenna amplifier and enabling the latter to be removed or mounted on the window as may be desired. The connection included contact springs. The contact springs generally were mounted on a printed circuit board of the antenna amplifier and were soldered to it and had a portion engaging through a cutout in the printed circuit board. After potting of the antenna amplifier, the contact springs projected therefrom and were able, with the underside of the antenna amplifier, to make contact directly or indirectly with the contact pads of the antenna.

In instances in which the antenna amplifier was completely potted in a synthetic resin material, repair in the case of a broken contact frame was practically impossible or required complex and expensive handling. Even where the contact springs were accessible, the manufacture of an antenna amplifier was expensive since the contact springs could be provided only on one side of the printed circuit board and soldering had to be used.

In addition, the contact springs hitherto provided did not retain their characteristics for the length of time desired, generally the useful life of the vehicle, and were unsatisfactory in that respect as well.

OBJECTS OF THE INVENTION

It is the principal object of the present invention to provide an antenna device for a motor vehicle whereby the antenna structure can be connected with contact springs with an electronic unit, especially an antenna amplifier, in which the replaceability of the electronic unit poses no problem and yet the handling of the electronic unit, the assembly of the system and its dismounting, are not detrimental to the contact spring.

Another object of the invention is to provide an improved contact spring assembly consisting of an antenna structure, the contact spring and an electronic device, especially an antenna amplifier, whereby drawbacks of earlier systems are avoided.

SUMMARY OF THE INVENTION

These objects and others which will become apparent hereinafter are achieved, in accordance with the invention by providing a carrier plate which is juxtaposed with a flat surface of the vehicle carrying the antenna structure, usually a window of the vehicle and which is provided with at least one recess or opening receiving at least one contact spring which has resilient portions on opposite sides of that contact plate so that the electronic device can bear with one contact location against a portion of that spring on one side of the support plate while a contact location of the antenna structure is engaged by the contact spring on the opposite side of the support plate.

In other words, the support plate receives a contact spring such that the electronic device, especially an antenna amplifier, engages one contact surface of the contact spring while another contact surface of the contact spring bears against a contact point (pad or foot) of the antenna structure.

According to the invention, therefore, the support plate has at least one contact spring interposed between the electronic device, especially the antenna amplifier, and a contact surface of the antenna structure. The antenna amplifier in that case need no longer have a contact spring itself, but rather only a contact point or pad, which need not be bent or subject to breaking. However, in spite of the lack of a contact spring built onto or into the electronic device, a reliable contact can be formed because the resilience is provided by the contact spring mounted in and on the support plate.

This is especially the case when the contact springs are of such shape and construction that they can be disposed in the carrier plate and locked therein such that only bent portions of the contact spring are engageable above and below the contact plate and no free edges or arms project from the contact plate. This can be achieved especially by ensuring that the contact spring is anchored in a hole or a plurality of holes in the contact plate.

The system of the invention retains the advantages of EP 1 080 513 B1 with respect to the ease of mounting and dismounting of the antenna amplifier via the carrier plate but has the further advantages of providing a more reliable and easily established contacting between the antenna structure and the antenna amplifier which amplifies the antenna signal and delivers them to further processing circuitry.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
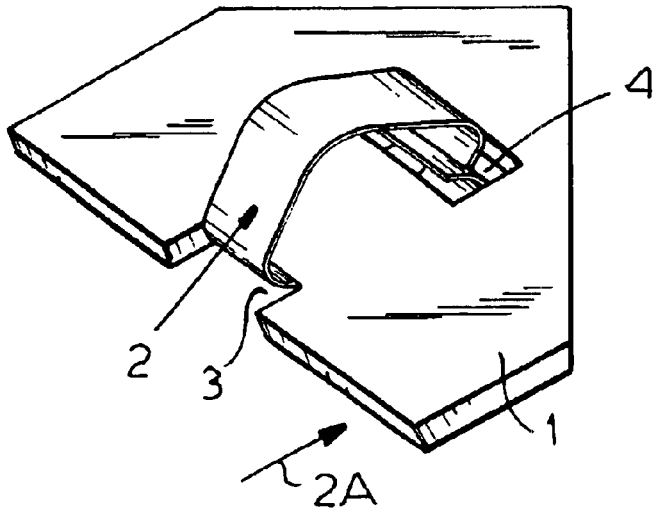
FIG. 1 is a perspective view showing a contact spring according to the invention on a carrier plate before mounting.
Figure 1A:
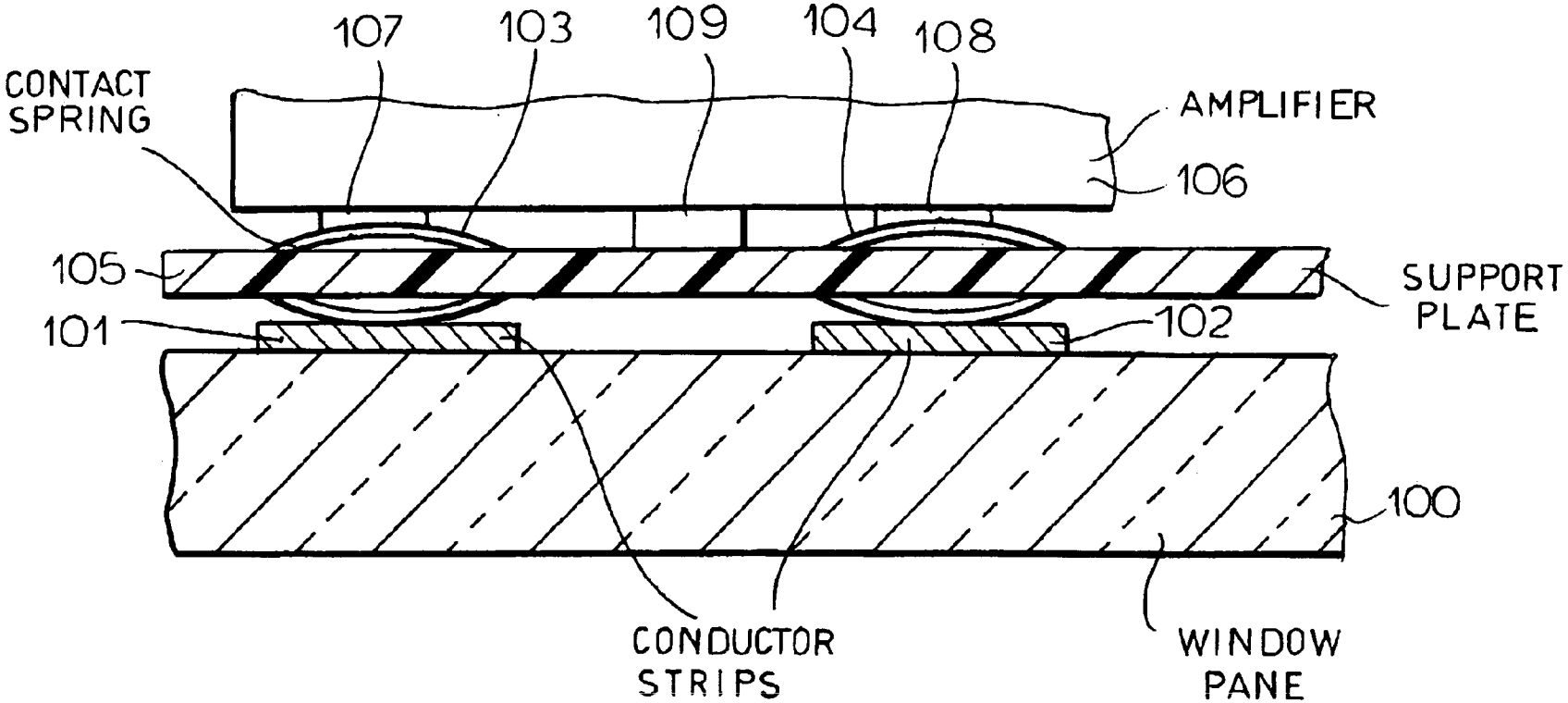
FIG. 1A is a cross sectional view showing the combination of an antenna amplifier, the motor vehicle window and the support plate with a plurality of contact springs engaging conductor strips on the window pane.

Referring first to FIG. 1A, it can be seen that a system according to the invention can comprise as shown in EP 1 030 513 B1, for example (see FIG. 1 and column 8, line 9 through column 10, line 41 thereof), a window or window pane 100, e.g. the rear window of an automotive vehicle, which has conductive strips printed thereon to form an antenna, those conductive strips having exposed conductor pads 101, 102, etc. The conductor strips on the window pane 100 are contacted in turn by contact springs 103, 104, etc., mounted in a support plate 105 of electrically nonconducting material. A high-frequency amplifier 106 having contacts 107, 108, engaging the contact springs 103, 104, may be mounted upon the support plate 105 and can make its electrical connection with the contactor strip 101, 102 through the contact spring. FIGS. 1–14 show various embodiments of the contact springs according to the invention and their respective arrangements on the support plate.

Figure 2:
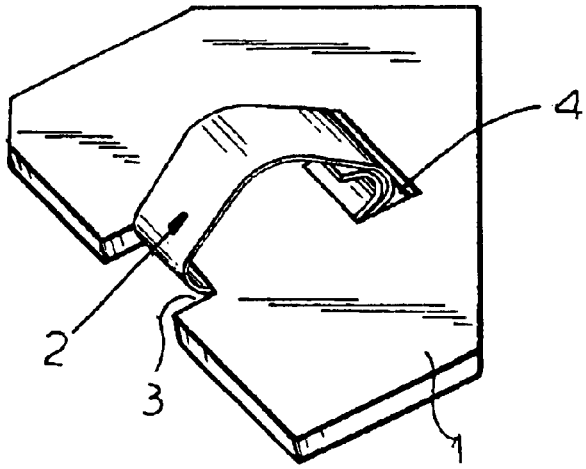
FIG. 2 is a view similar to FIG. 1 showing the support plate after the mounting of the contact springs in place.

In FIGS. 1 and 2, for example, the support plate has been represented at 1 and has a notch 3 open at an edge of the support plate 1 and a recess or hole 4 into which a contact spring 2 can be lockingly engaged.

The support plate 1, of which only a portion has been shown in FIGS. 1 and 2, is designed to be mounted on a flat part of the vehicle, especially a vehicle window, particularly the rear window of the vehicle carrying the printed antenna strips or in which antenna wires are embedded and printed at contact strips or contact pads as described in connection with FIGS. 1A. The plate 1 can be a printed circuit board or simply an insulated plate and can be affixed to the vehicle window by any conventional means, for example, by an adhesive.

The support plate 1 has as its primary function the support or mounting of the antenna amplifier 106 and can facilitate its mounting or dismounting and for that purpose can have hooks, mounting screws or the like, represented only generally at 109 in FIG. 1A, to facilitate the mounting and dismounting of the amplifier.

The mounting and dismounting means can be those described in the aforementioned EP 1 080 513 B1.

As noted, contact springs 2, which are clipped into the board or plate 1 serve to make electrical contact with at least one contact location on the flat part of the vehicle, for example, a contact pad or foot of the antenna structure on the vehicle window, and the associated contact in the antenna amplifier. The contact springs may have the configuration shown in FIGS. 1 and 2 which can correspond to the configurations in FIGS. 3 and 4.

The contact springs 2 are composed of electrically conductive material with spring properties so that their arms tend to snap together when the spring is pressed in the mounting direction represented by the arrow 2A in FIG. 1 over the edge of the plate 1 in the notch 3 so that the ends of the arm engage in the hole 4.

The contact spring is generally of U shape, i.e. has a bight 2*a* with two arms which are concave toward one another. This U shape has the best high-frequency property. Depending upon the frequency range in which the antenna operates, however, a spiral configuration of the spring may be of advantage as well. The spring is intended to operate with antennae in the MHz range to the GHz range.

These contact springs 2 are fabricated as individual elements and are then mounted on the support plate 1 to provide the contacts between the antenna structure and the antenna amplifier. As many contact springs 2 as are required for this purpose can be fitted onto the carrier plate.

As noted, each carrier plate 1 has at least one cutout, hole or recess into which the contact spring can be engaged in a self-locking manner.

In the embodiment shown in FIGS. 1–4, the recesses for each contact spring 2 can include a notch 3 along one side or edge of the carrier plate 1 and serving to fix the base of that contact spring along the carrier plate 1 and hence relative to all other contact springs.

In addition, the notch 3 serves as a guide, orienting the respective contact spring during the mounting. The contact springs 2 are thus thrust over the support plate 1 at each of the notches 3. The notches 3 can be directly felt and visualized by the person mounting the contact spring on the support plate 1 so that that individual will immediately recognize the locations at which contact springs are to be mounted.

Naturally, just the opening 4 within the support plate 1 can be provided for each contact spring and the respective notch omitted. Alternatively, instead of a through opening 4 in which both ends of the contact spring engage, shallow recesses can be provided on one or both sides of the carrier plate to receive respective inwardly bent ends of the arms or shanks of the contact spring. The inwardly bent arms of the contact spring can bear against one another in the embodiment of FIG. 3 or can be fitted one into the other (see FIG. 4), if they are not to engage in shallow recesses. The inward force of the shanks or arms of the contact spring then hold the contact spring in place in the latter case.

Depending upon the geometric configuration of the contact spring, the way in which each contact spring 2 can engage in the plate 1 can vary. For example, in the positions shown in FIGS. 2 and 3, the two ends of the arms do not overlap but serve to lock the contact spring in the hole 4. The contact spring 2 then fits around the web or portion of the support plate 1 between the notch 3 and the hole 4. If one end is fitted over the other end so that the ends overlap (FIG. 4), the contact spring can be anchored in place without being able to be pulled off except if the ends are bent apart. In any event, once the contact spring is fitted onto the support plate 1, the two arms can be pressed together resiliently to maintain pressure on the contact pads regardless of whether they are merely hooked into the opening 4 (FIG. 3) or are overlapped (FIG. 4).

Figure 3:
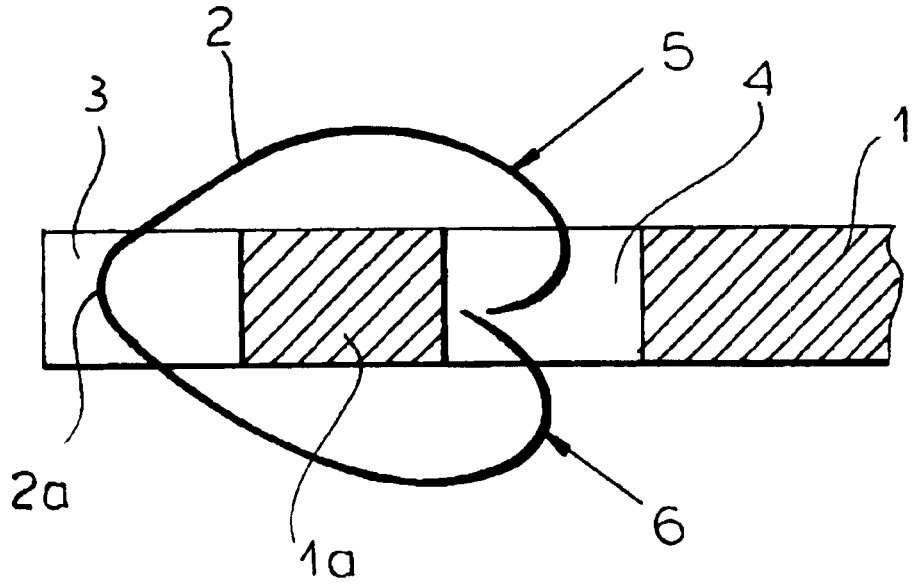
FIG. 3 is a cross sectional view showing a contact spring after it has been snapped into a recess in the support plate.
Figure 4:
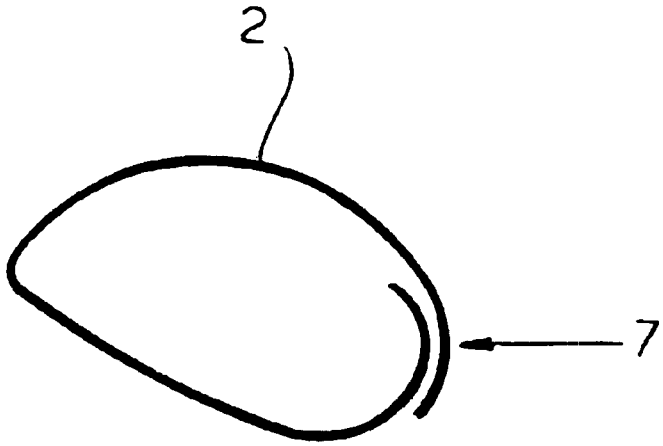
FIG. 4 is a side elevational view diagrammatically showing the spring before it has been locked onto the support plate.

FIGS. 3 and 4 show the principles of the invention in greater detail with respect to the locking aspect. From FIG. 3 it will be apparent that the contact spring is displaced from left to right onto the carrier plate 1 until the inwardly bent ends 5 and 6 of the shanks snap into the opening 4 in the carrier plate 1.

The ends 5 and 6 of the shanks or arms of the contact spring 2 are bent with the radius of curvature or different radii of curvature inwardly with respect to one another. In the preferred embodiment they have the same or similar radii of curvature.

In the position shown in FIG. 3, the inwardly bent ends 5 and 6 prevent the contact spring 2 from pulling off the carrier plate 1 readily.

To further lock the contact spring 2 in place, the two ends 5 and 6 are pressed together until one end snaps over the other in a locking region represented at 7 and shown in FIG. 4. In FIG. 4 the plate 1 has been omitted but it will be understood that the locking position shown in FIG. 4 continues to have the web 1*a* of the carrier plate 1 between the recesses 3 and 4 located between the shanks of the spring and thus within the locked spring of FIG. 4. The spring thus has the resilient characteristics required when the spring is compressed between a contact on one side of the board and a contact on the opposite side of the board, i.e. the contacts of the antenna on the one hand and the antenna amplifier on the other.

The configuration of the contact spring shown in FIGS. 1–4 has numerous advantages. Firstly, the same contact spring or a contact spring of the same shape can be used for different support plates in the sense that different spacings of the notch 3 and opening 4 can be readily accommodated as can different thicknesses of the support plate.

If desired many of the same size contact springs can be accommodated on a given support plate or contact springs of larger or smaller size may be provided on the same support plate. Should, for example, any of the contact springs be damaged during mounting, transport, or at some other time, the contact spring can easily be pulled open and removed from the board and replaced by other identical or different contact springs.

The illustrated shape of the contact spring has been found to be highly advantageous in preventing damage and by and large the contact springs are insensitive to rough handling or loss from the contact plate.

Figure 5:
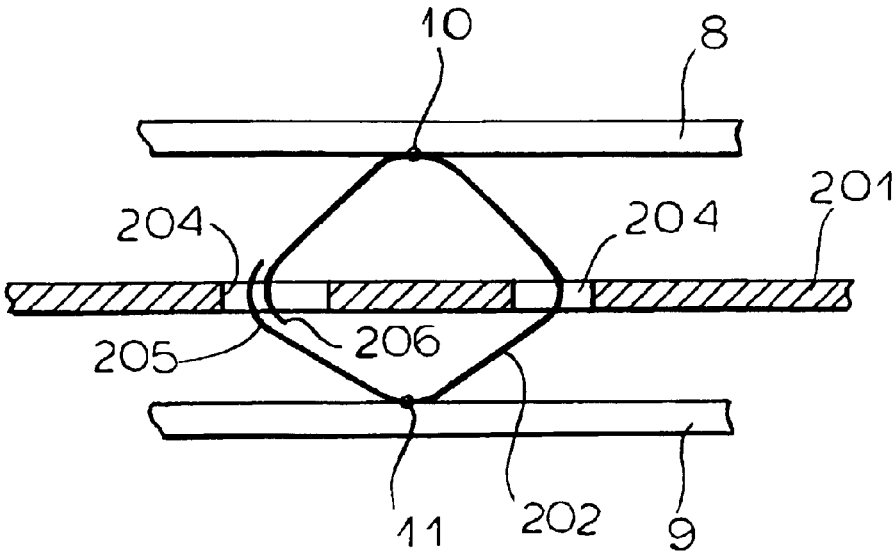
FIG. 5 is a cross sectional view showing the positioning of a contact spring between contact parts.

FIG. 5 shows an embodiment in which a contact spring 202 is located within holes 204 of a contact plate 201 with ends 205 and 206 overlap as indicated. The carrier plate 201 is a plate of synthetic resin or other insulating material or a printed circuit board for an electronic unit such as an antenna amplifier and is located between two contact pads 8 and 9 which press the contact spring 202 between them. The contact spring engages the pads 8 and 9 at contact regions 10 and 11. Because the contact spring 2 is of a high conductivity metal the contact locations 8 and 9 are electrically connected together and the resilience and yieldability of the contact spring allows tolerances between the position of the pads 8 and 9 to be readily accommodated. The contact regions 10 and 11 are quasi point-shaped and could have diameters of up to several millimeters.

Figure 6:
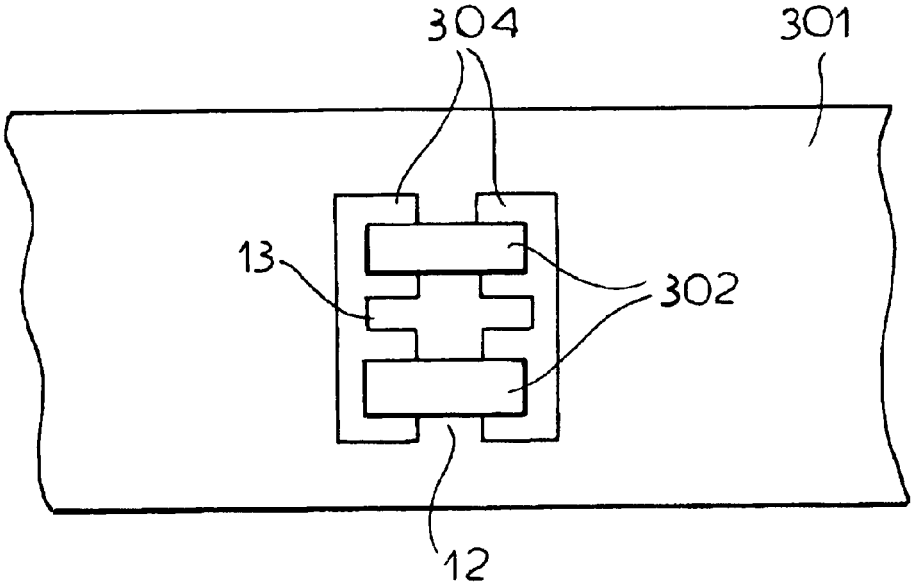
FIG. 6 is a plan view of the support plate showing two contact springs disposed adjacent one another.

In the embodiment of FIG. 6, it will be apparent that a plurality of contacts 302 may be fitted into holes 304 in a support plate 301. The holes 304 are of rectangular configuration and the web 12 between them can have projections 13 which lie between the contacts 302 and thus separate them from one another. The contacts can have the configuration shown in FIGS. 1–4 or that of FIG. 5. The projections 13 form presses preventing electrical contact of members 302 with one another. While the spacers 13 here form part of the support plate 301 they can, of course, be separate elements.

FIGS. 7A–7D show a further contact spring 402 which can have cutouts 14 in each of the shanks 15 and 16. The cutouts 14 modify the spring characteristics of the contact spring. In addition, they provide a number of separate contact points as indicated at 10 and 11 in FIG. 5 for the respective contact pads 8 and 9 so that a better and more reliable contact is provided between the spring and any member engaging same. This is especially the case where there is a danger that oxidation may interfere with a good contact.

Figure 7A:
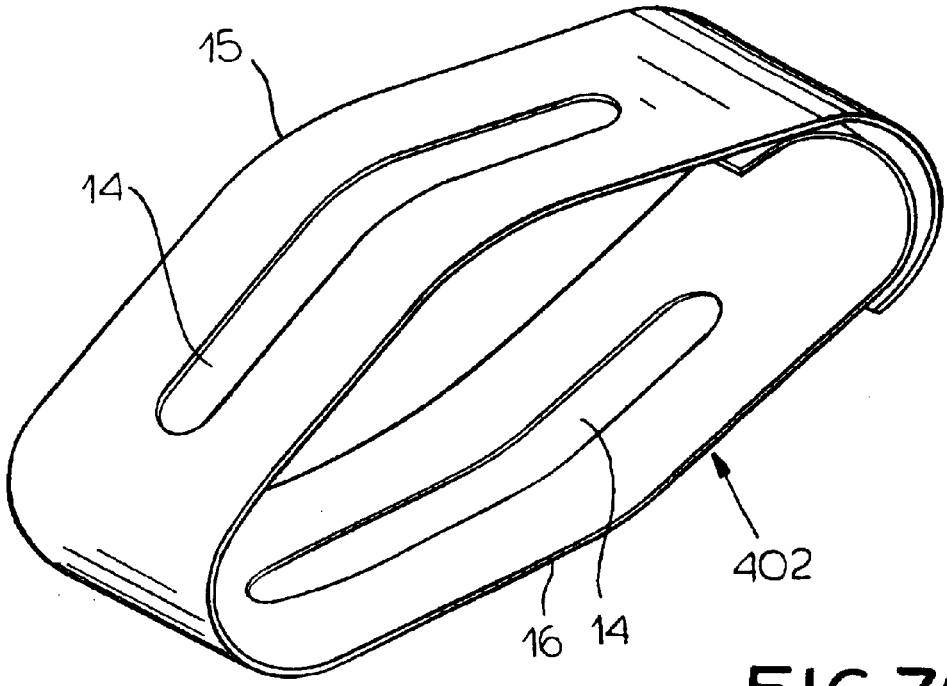
FIG. 7A is a perspective view of a contact spring with cutouts for altering the spring characteristic.
Figure 7C:
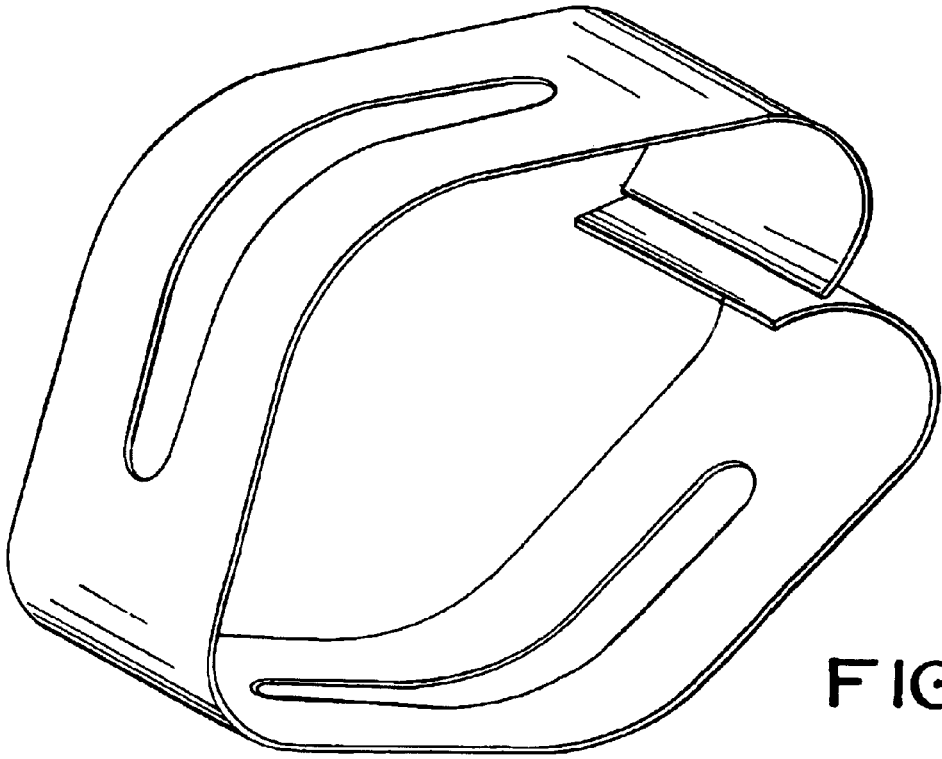
FIG. 7C is a perspective view of the contact spring with its legs separated and about to be fitted over a support plate.
Figure 7B:
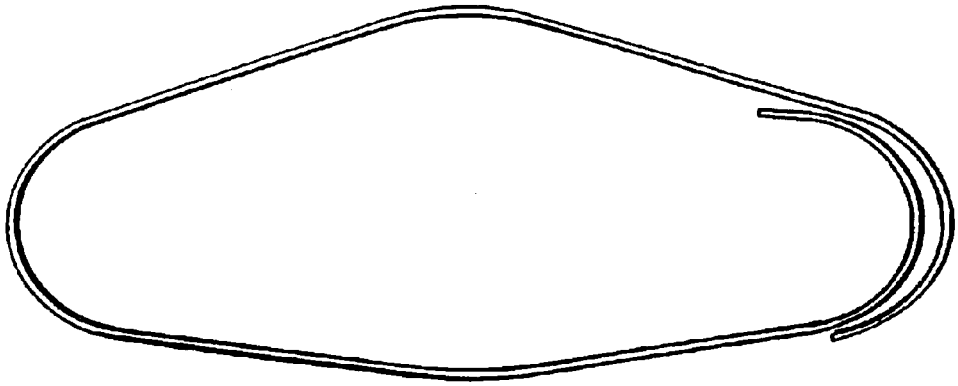
FIG. 7B is a side elevational view of this contact spring.
Figure 7D:
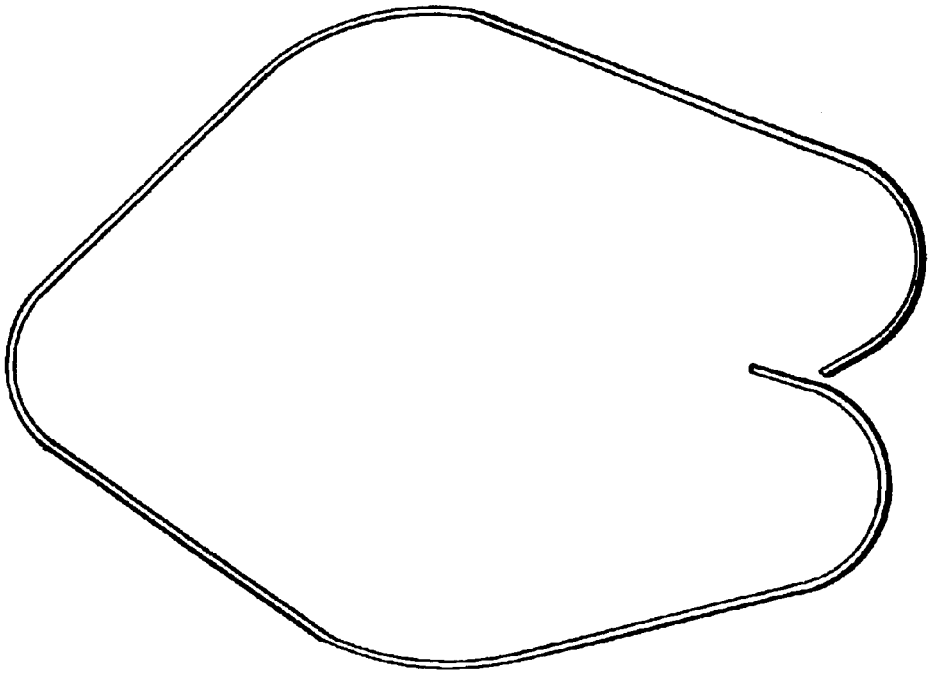
FIG. 7D is a side elevational view of the contact spring of FIGS. 7A–7C in the position shown in FIG. 7C.
Figure 8:
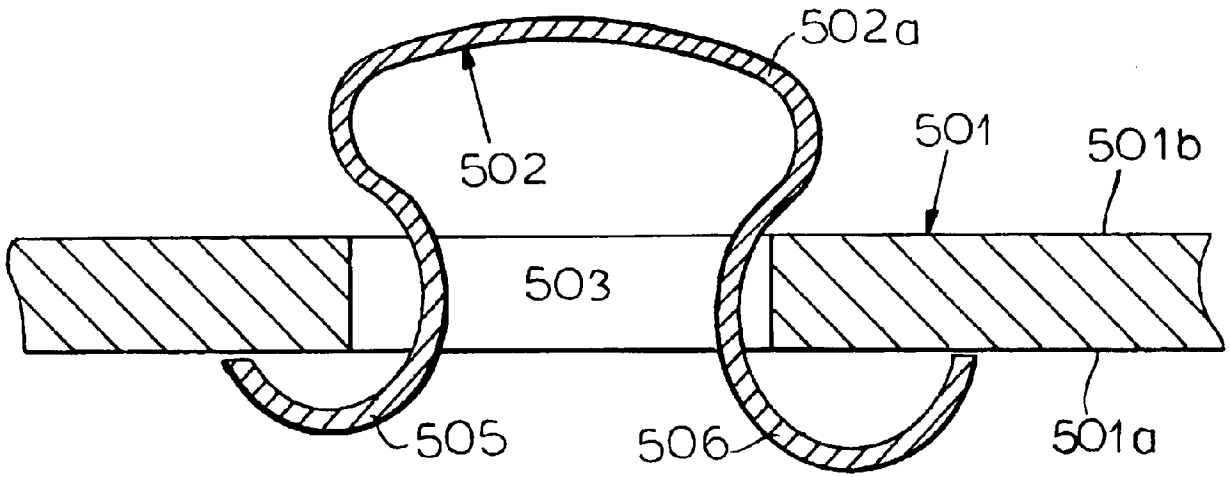
FIG. 8 is a cross sectional view showing another contact spring snapped into a hole in the support plate.

While only one slot-shaped cutout 14 is provided in each shank 15 or 16, it is possible have in each shank a plurality of such slots parallel to one another if desired. The different showings of the contact spring 402 in FIGS. 7A–7D are intended to illustrate the positions of the shank before locking in the support board (FIGS. 7C and 7D) and after such locking (FIG. 7A and 7B).

In FIGS. 8—13, various other shapes of contact springs have been shown and their use with one or more holes has been illustrated. For example, in FIG. 8 an ω-shaped contact spring 502 has been shown with shanks 505 and 506 bent away from one another and locked against the opposite side 501*a* of a support plate 501 from the side 501*b* from the bight 502*a* projects. The contact spring is received in a single hole 503 of the contact plate 501.

Figure 9:
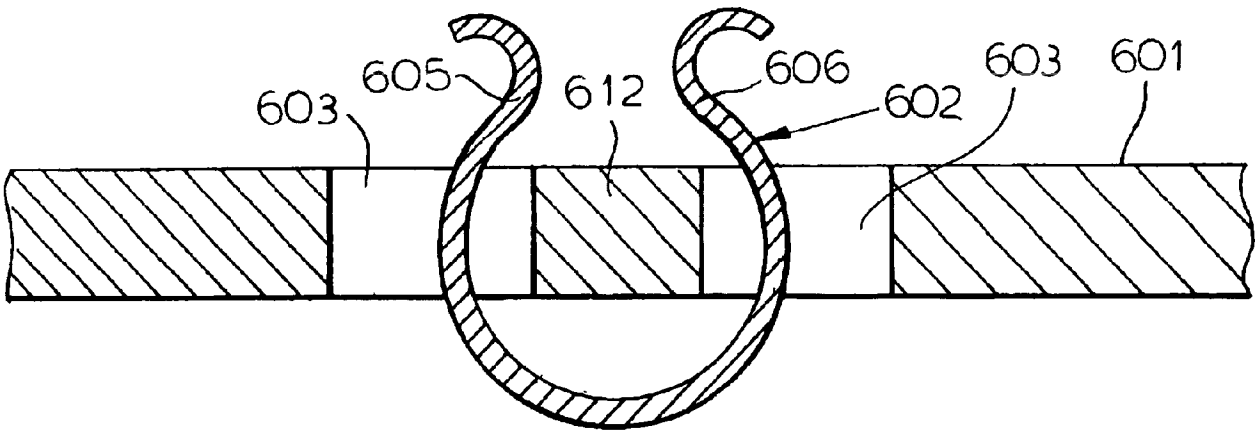
FIG. 9 is a view similar to FIG. 8 but of an ω-shaped contact spring snapped through two holes in a support plate around a web between those holes.

The contact spring 602 of FIG. 9 also has a general ω shape but the shanks 605 and 606, having their ends bent away from one another, are received in two openings 603 formed in the contact plate 601 and thus lie on opposite sides of a web 612.

Figure 10:
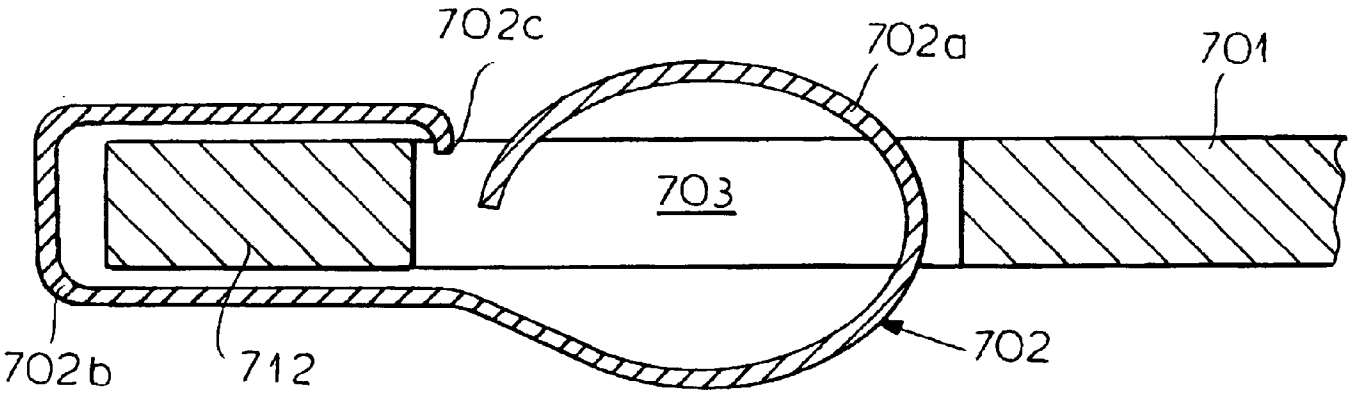
FIG. 10 is a cross sectional view showing a contact spring of a somewhat different configuration snapped over an edge of the support plate.

In the embodiment of FIG. 10, the contact spring 702 has the configuration of a question mark, with a loop 702*a* received in the single opening 703 of a contact plate 701 and a leg 702*b* which engages around a portion 712 of the contact plate and locking the spring in place by an inwardly bent edge 702*c*.

In this embodiment the spring engages around a web 712 at the edge of the support plate 701 and not between holes as in FIG. 9.

Figure 11:
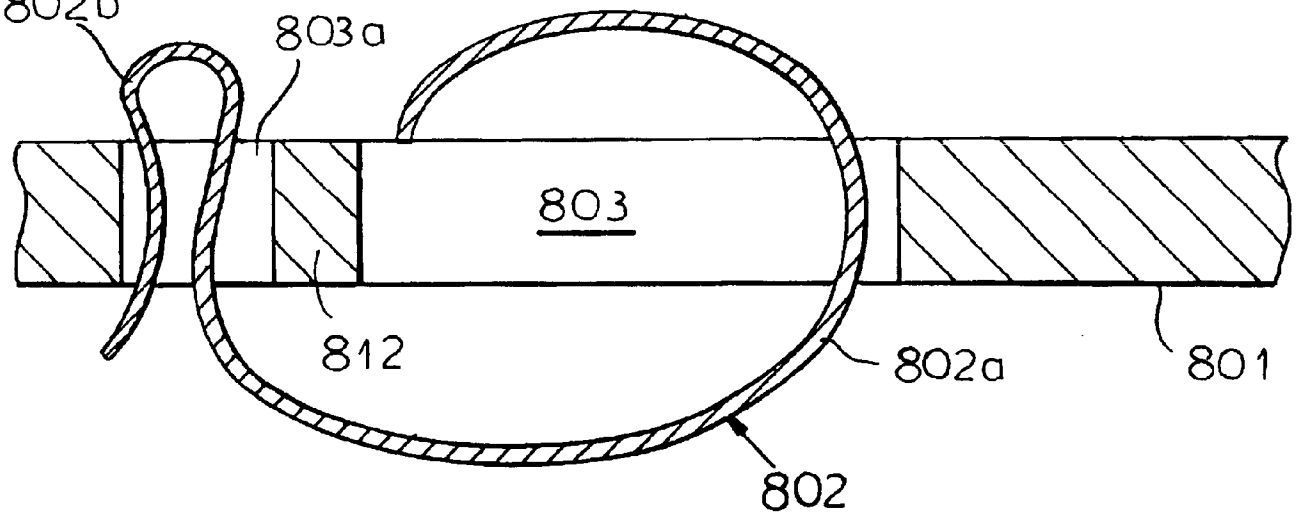
FIG. 11 is a cross sectional view of yet another contact spring arrangement engaged in two holes of a support plate.
Figure 12:
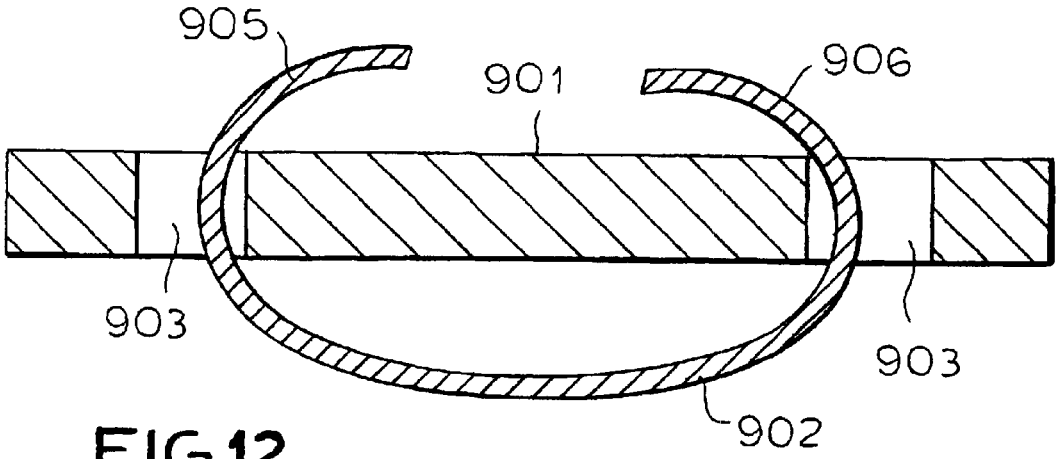
FIG. 12 is a cross sectional view through a contact spring arrangement where a spring is generally C-shaped.
Figure 13:
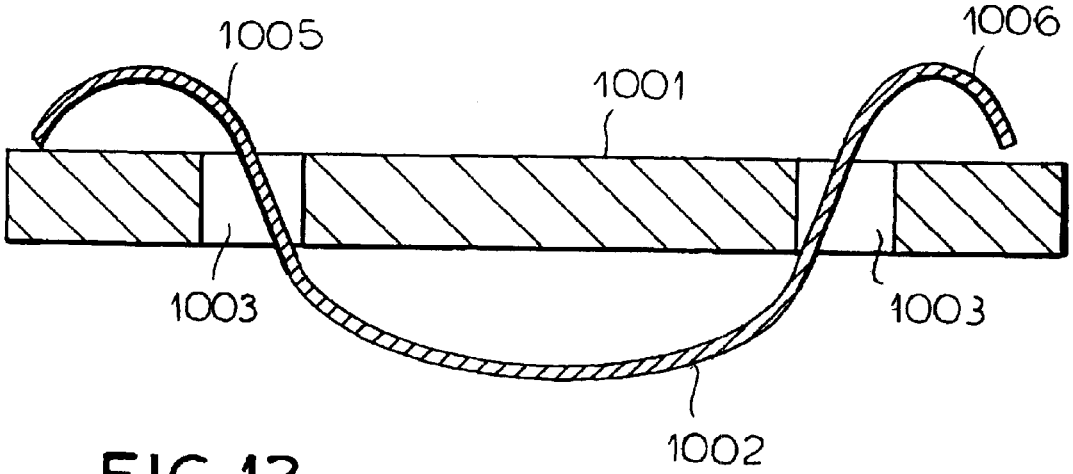
FIG. 13 is a cross sectional view of a contact spring engaged through two holes of a contact plate in which the spring has the configuration of a wave form.

In the embodiment of FIG. 11, a loop 802*a* of the contact spring 802 extends into the opening 803 of the contact plate 801 while the hairpin-shaped portion 802*b* engages in another opening 803*a* in the contact plate 801, separated from the larger opening 803 by a web 812. In the embodiment of FIG. 12 a C-shaped contact spring 902 engages through two openings 903 in the contact plate 901 and the ends 905 and 906 are bent toward one another. In a modification of the embodiment shown in FIG. 8, a contact spring 1002 has its outwardly bent shank 1005 and 1006 engaging through openings 1003 in the contact plate 1001. That embodiment is shown in FIG. 13.

Figure 14:
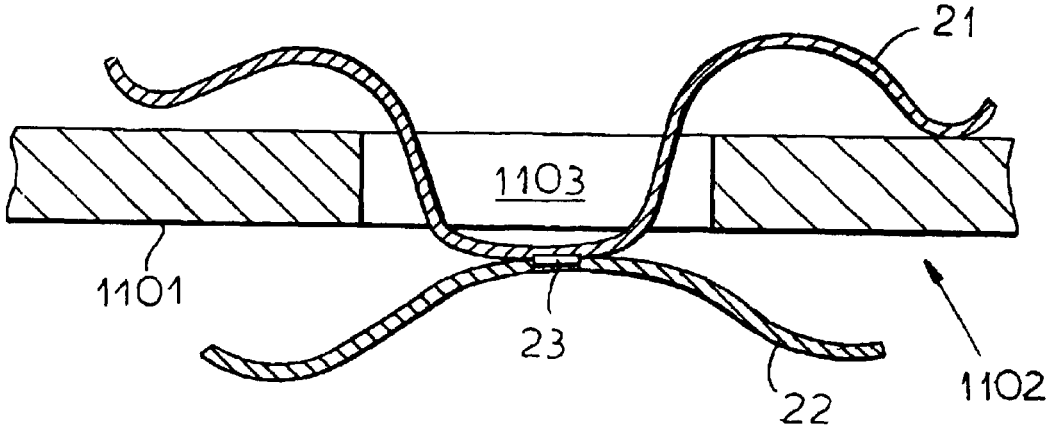
FIG. 14 is a cross sectional view through a system utilizing a two-piece contact spring with the parts thereof connected together by spot welding.

FIG. 14 indicates that the contact spring 1102 can be comprised of at least two contact spring parts 21 and 22 which are spot welded together at a connection point 23. Because of this nondetachable connection of the two contact parts, the contact spring 1102 can be locked in an opening 1103 of a support plate 1101, the contact part 22 preventing the contact part from being withdrawn through that opening and vice versa. Instead of a spot-weld, a rivet, a crimped connection, an adhesive bonding using a conductive adhesive, soldering or the like can be used to join the relatively flat component 22 to the more distinctly bent component 21.

With the contact springs of the embodiments of FIGS. 8, 9, 11, 12, 13 and 14 it is possible to provide on each side of the support plate more than one contact location.

In the case in which the printed circuit board of the antenna amplifier is arranged in a one-part or multipart housing with at least one contact spring in the housing of the antenna amplifier, the contact spring with one of the configurations shown can simply press through an opening in the support plate to make contact on the opposite side, in which case the contact springs of the invention will be mounted upon the printed circuit board of the antenna amplifier directly and need not be provided on a separate support plate between the antenna amplifier and the antenna. In that case a separate support plate might be omitted in its entirely since that function will be assumed by the printed circuit board of the antenna amplifier.

The contact springs in all embodiments should be composed of a material of high electrical conductivity as well as of high strength and restoring force. A spring of copper-bronze material may be used. When the spring characteristic is to be constructed by a metal other than of highly conductive metal, the spring may be coated with copper, gold or the like.

I claim:

1. An antenna contacting assembly for a motor vehicle having a flat portion comprising:

an antenna structure on said flat portion of said vehicle and provided with at least one contact pad;

an electronic device having a contact point adapted to be connected to said contact point; and a carrier plate between said electronic device and said antenna structure and disposed on said flat part of said vehicle and a contact spring mounted on said carrier plate and engageable by said contact point on one side of said carrier plate and engaging said contact pad on an opposite side of said carrier plate for electrically connecting said contact point with said contact pad, said contact spring having contact surfaces along bent portions of said contact spring in engagement with said contact point and said contact pad.

2. The assembly defined in claim 1 wherein said support plate has at least one recess in which said contact spring is engaged.

3. The assembly defined in claim 2 wherein said recess is a hole and said contact spring is locked in said hole.

4. The assembly defined in claim 3 wherein said electronic device is an antenna amplifier.

5. The assembly defined in claim 4 wherein said antenna amplifier is mounted on said support plate.

6. The assembly defined in claim 3 wherein said two recesses are provided for said spring and said spring engages in both of said recesses and at least partly surrounds a web of said contact plate between said recesses.

7. The assembly defined in claim 6 wherein said recesses are elongated and parallel to one another.

8. The assembly defined in claim 7 wherein said support plate has at least two of said contact springs engaging in said recesses and a spacer is provided between said contact springs to prevent them from contacting one another.

9. The assembly defined in claim 8 wherein said spacer is a projection formed on said support plate between said contact springs.

10. The assembly defined in claim 3 wherein said contact spring is generally U-shaped and has shanks with bent ends engaging in recesses in said support plate.

11. The assembly defined in claim 3 wherein said contact spring is generally U-shaped and shanks of said contact spring are bent to engage one in another.

12. The assembly defined in claim 3 wherein said contact spring has at least one cutout for adjusting a spring characteristic thereof.

13. The assembly defined in claim 12 wherein said cutout is an elongated slot formed in at least one shank of said contact spring.

14. The assembly defined in claim 3 wherein said contact spring has at least two parts connected permanently with one another at a connecting point.

15. The assembly defined in claim 3 wherein said flat part is a window of said vehicle.

* * * * *